US008830086B2

(12) United States Patent
Cao et al.

(10) Patent No.: US 8,830,086 B2
(45) Date of Patent: Sep. 9, 2014

(54) ADJUSTING TRAFFIC LIGHTS

(71) Applicant: International Business Machines Corporation, Armonk, NY (US)

(72) Inventors: Rong Zeng Cao, Beijing (CN); Zhao Cao, Beijing (CN); Wei Ding, Beijing (CN); Hou Li Duan, Beijing (CN); Peng Gao, Beijing (CN); Zhen Lei, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 89 days.

(21) Appl. No.: 13/661,078

(22) Filed: Oct. 26, 2012

(65) Prior Publication Data

US 2013/0106620 A1 May 2, 2013

(30) Foreign Application Priority Data

Oct. 28, 2011 (CN) ..... 2011 1 0341944

(51) Int. Cl.
*G08G 1/07* (2006.01)

(52) U.S. Cl.
USPC ..... 340/911; 340/910; 340/913; 340/914; 340/917; 701/117

(58) Field of Classification Search
USPC ..... 340/907–923; 701/117, 118, 70
See application file for complete search history.

(56) References Cited

U.S. PATENT DOCUMENTS

| | | | | |
|---|---|---|---|---|
| 8,655,575 | B2 * | 2/2014 | Reghunath | 701/117 |
| 2002/0116118 | A1 * | 8/2002 | Stallard et al. | 701/117 |
| 2008/0172171 | A1 * | 7/2008 | Kowalski | 701/118 |
| 2009/0138187 | A1 | 5/2009 | Mathias | |
| 2011/0191011 | A1 * | 8/2011 | McBride et al. | 701/117 |

FOREIGN PATENT DOCUMENTS

| | | |
|---|---|---|
| CN | 1687977 | 10/2005 |
| CN | 201017478 U | 2/2008 |

* cited by examiner

*Primary Examiner* — Brent Swarthout
(74) *Attorney, Agent, or Firm* — Jeff Tang

(57) ABSTRACT

A method and system for adjusting traffic lights. The method and system can dynamically divide a region according to the road congestion situation and adjust traffic lights in a resulting control region according to the control region, so as to solve the traffic congestion problem. The system for adjusting traffic lights includes: a congestion determining module, a control region determining module and a adjusting module, wherein the control region determining module is configured to determine a control region according to a dispersion demand of a first phase and a dispersal capability of a corresponding phase of an adjacent intersection, and the adjusting module is configured to adjust traffic lights of at least one corresponding phase of an adjacent intersection in the control region so as to relieve the traffic congestion situation at the first phase of the first intersection. Also described is a corresponding method for adjusting traffic lights.

19 Claims, 6 Drawing Sheets

ADJUSTING TRAFFIC LIGHTS

CROSS REFERENCE TO RELATED APPLICATION

The present invention claims priority under 35 U. S. C. 119 from Chinese Application number 201110341944.1 filed Oct. 28, 2011, the entire contents of which is incorporated herein by reference.

BACKGROUND OF THE INVENTION

1. Field of the Invention

The present invention generally relates to a method and system for processing traffic data, and more specifically, to a method and system for adjusting traffic lights.

2. Description of Related Art

Traffic control means effectively guiding and scheduling traffic flow through traffic lights at road intersections, in order to temporally-spatially split traffic flow that is likely to conflict. Traditional traffic control methods mainly include timing control, multi-period control, inducted or semi-inducted control, green wave band control and static region control. Timing control is based on Webster's equation for vehicle delay via which an approximation of best cycle can be obtained. Multi-period control is actually segmented timing control. Usually citizens' travel illustrates obvious regularity; for example, rush hours of traffic flow often take place at 7:00 a.m.-8:00 a.m. in the morning, 11:00 a.m.-12:00 p.m. at noon and 5:30 p.m.-6:30 p.m. Therefore, it is possible to select an optimal timing scheme for each period and perform multi-period control.

Currently, one adaptive control system that has been put into large-scale application is SCOOT. This system detects traffic flow data in real time by vehicle detectors, optimizes signal timing parameters by using a traffic model, and performs control by using communication networks, signal controllers and other hardware devices. In addition to formulating a timing scheme, this model may provide other information, such as delay, stopping times and congestion data, so as to serve traffic management and planning. Typically the SCOOT system divides an entire controlled region into a number of independent sub-regions. Intersections within the same sub-region use one identical signal cycle. An objective of periodical optimization is to control the vehicle waiting time average in sub-regions within certain range. And in order to prevent the sudden change of signal parameters from exerting adverse effect on traffic flow, SCOOT uses a small increment approach during optimization and adjustment.

A drawback of the SCOOT system is that the SCOOT system divides a region in a static way. Statically dividing a region is usually designated according to initial experience of traffic experts and can hardly adapt to the rapid road change demand. Besides, an objective of signal periodical optimization in the SCOOT system is to reduce vehicle waiting time average in static regions, which focuses on overall control of the entire region. Moreover, the SCOOT system performs adjustment by a change with a small step and thus, it perhaps cannot respond in time to the traffic demand during each period.

SUMMARY OF THE INVENTION

According to one embodiment of the present invention, a system for adjusting traffic lights, includes: a congestion determining module configured to determine whether or not congestion occurs at a first phase of a first intersection; a control region determining module configured to, in response to congestion occurring at the first phase of the first intersection, obtain a dispersion demand of the first phase of the first intersection and a dispersal capability of a corresponding phase of an adjacent intersection, and determine a control region according to the dispersion demand of the first phase and the dispersal capability of the corresponding phase, wherein the control region includes at least one corresponding phase of an adjacent intersection; and an adjusting module configured to adjust traffic light(s) of the at least one corresponding phase of an adjacent intersection in the control region so as to relieve the traffic congestion situation at the first phase of the first intersection.

According to another embodiment of the present invention, a method for adjusting traffic lights, includes: determining whether or not congestion occurs at a first phase of a first intersection; in response to congestion occurring at the first phase of the first intersection, obtaining a dispersion demand of the first phase of the first intersection and a dispersal capability of a corresponding phase of an adjacent intersection, and determining a control region according to the dispersion demand of the first phase and the dispersal capability of the corresponding phase, wherein the control region includes at least one corresponding phase of an adjacent intersection; and adjusting traffic light(s) of the at least one corresponding phase of an adjacent intersection in the control region so as to relieve the traffic congestion situation at the first phase of the first intersection.

BRIEF DESCRIPTION OF THE DRAWINGS

The figures referenced in this specification are merely used for illustrating typical embodiments of the present invention and should not be construed as limiting the scope of the present invention.

DETAILED DESCRIPTION OF THE PREFERRED EMBODIMENT

Figure 1:
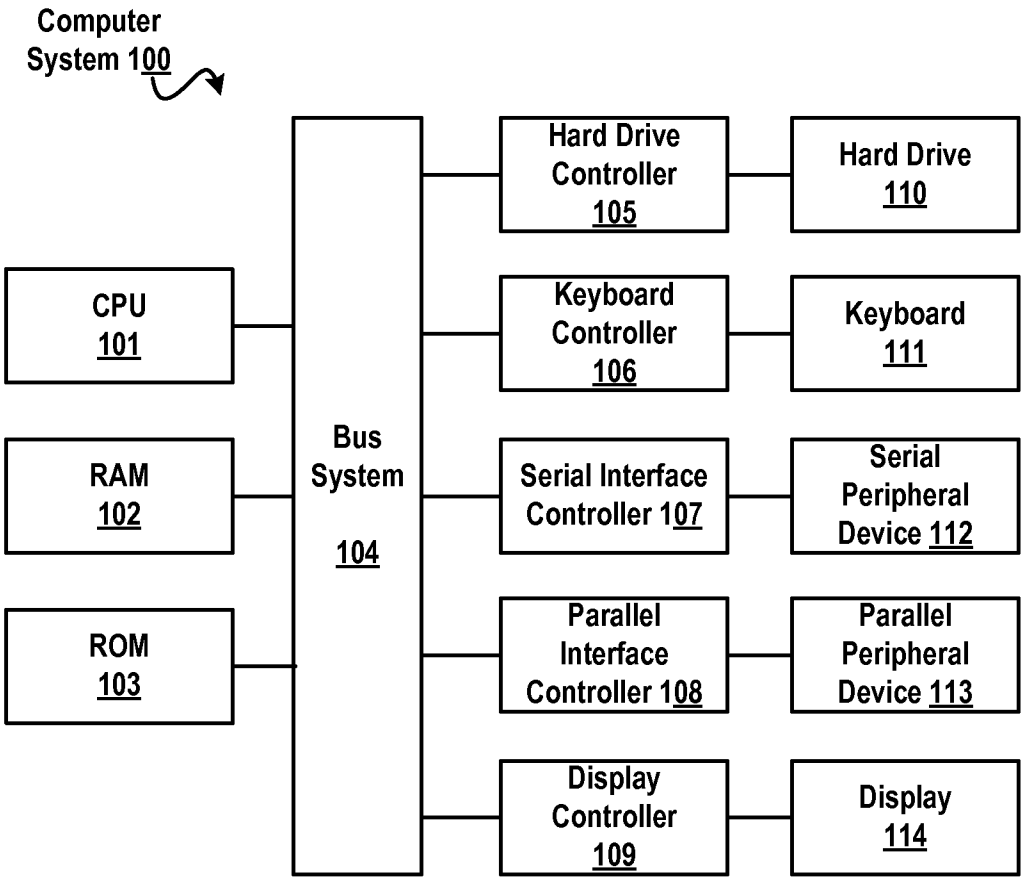
FIG. 1 illustrates an exemplary computer system which can be used to implement the embodiments of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, and/or components, and/or groups thereof.

The corresponding structures, materials, acts, and equivalents of all means or step plus function elements in the appending claims are intended to include any structure, material, or act for performing the function in combination with other claimed elements as specifically claimed. The description of the present invention has been presented for purposes of illustration and description, but is not intended to be exhaustive or limited to the present invention in the form disclosed. Many modifications and variations will be apparent to those of ordinary skill in the art without departing from the scope and spirit of the present invention. The embodiments were chosen and described in order to best explain the principles of the present invention and the practical application, and to enable others of ordinary skill in the art to understand the present invention for various embodiments with various modifications as are suited to the particular use contemplated.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or one embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable medium may be transmitted using any appropriate medium, including but not limited to wireless, wired, optical cable, RF, etc., or any suitable combination of the foregoing.

Program code embodied on a computer readable medium may be transmitted using any appropriate medium, including but not limited to wireless, wired optical cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks illustrated in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

FIG. 1 illustrates an exemplary computer system 100 which is applicable to implement the embodiments of the present invention. As illustrated in FIG. 1, the computer system 100 may include: CPU (Central Processing Unit) 101, RAM (Random Access Memory) 102, ROM (Read Only Memory) 103, System Bus 104, Hard Drive Controller 105, Keyboard Controller 106, Serial Interface Controller 107, Parallel Interface Controller 108, Display Controller 109, Hard Drive 110, Keyboard 111, Serial Peripheral Device 112, Parallel Peripheral Device 113 and Display 114. Among above devices, CPU 101, RAM 102, ROM 103, Hard Drive Controller 105, Keyboard Controller 106, Serial Interface Controller 107, Parallel Interface Controller 108 and Display Controller 109 are coupled to the System Bus 104. Hard Drive 110 is coupled to Hard Drive Controller 105. Keyboard 111 is coupled to Keyboard Controller 106. Serial Peripheral Device 112 is coupled to Serial Interface Controller 107. Parallel Peripheral Device 113 is coupled to Parallel Interface Controller 108. And, Display 114 is coupled to Display Controller 109. It should be understood that the structure as illustrated in FIG. 1 is only for the exemplary purpose rather than any limitation to the present invention. In some cases, some devices may be added to or removed from the computer system 100 based on specific situations.

Figure 2:
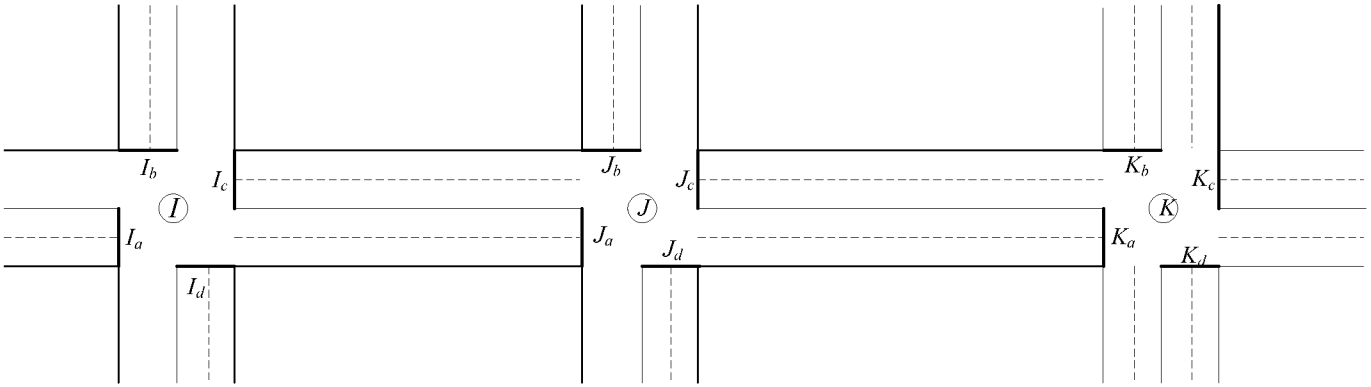
FIG. 2 is a schematic view of several adjacent intersections.

FIG. 2 illustrates a schematic view of several adjacent intersections. FIG. 2 schematically includes three intersections, namely intersection I, intersection J and intersection K. Each intersection includes four phases; that is, intersection I includes phases $I_a$, $I_b$, $I_c$ and $I_d$, intersection J includes phases $J_a$, $J_b$, $J_c$ and $J_d$, and intersection K includes phases $K_a$, $K_b$, $K_c$ and $K_d$. Suppose vehicles from phases $I_a$, $I_b$ and $I_d$ can arrive at phase $J_a$, and vehicles from phase $J_a$ can arrive at phase $K_a$. Hence, intersection I is an upstream intersection of intersection J and intersection K is a downstream intersection of intersection J. Phases $I_a$, $I_b$ and $I_d$ are upstream phases of $J_a$ and phase $K_a$ is a downstream phase of phase $J_a$. In the present invention, exemplary description is presented by way of the map in FIG. 2 only. In reality, however, the number of phases included by each intersection depends on actual road conditions.

Figure 3:
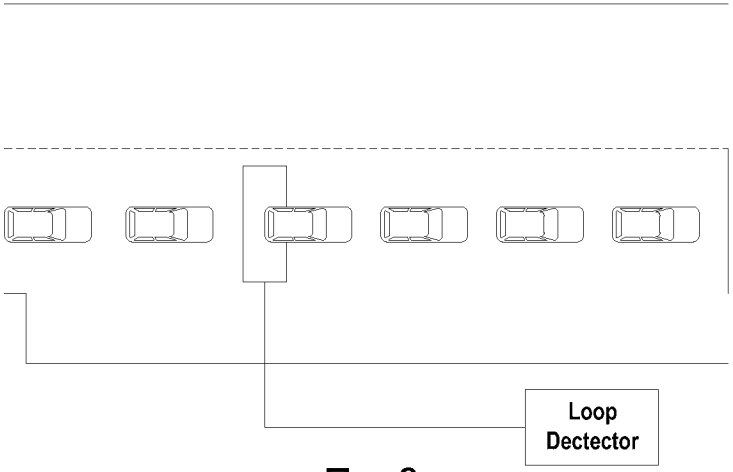
FIG. 3 is a schematic view of a loop detector on the road.

FIG. 3 illustrates a schematic view of loop detectors. According to the electromagnetic induction principle, loop detectors can sense whether a vehicle passes at a certain moment, and then calculates the speed at which the vehicle passes and the vehicle passing rate q within a unit time.

Figure 4:
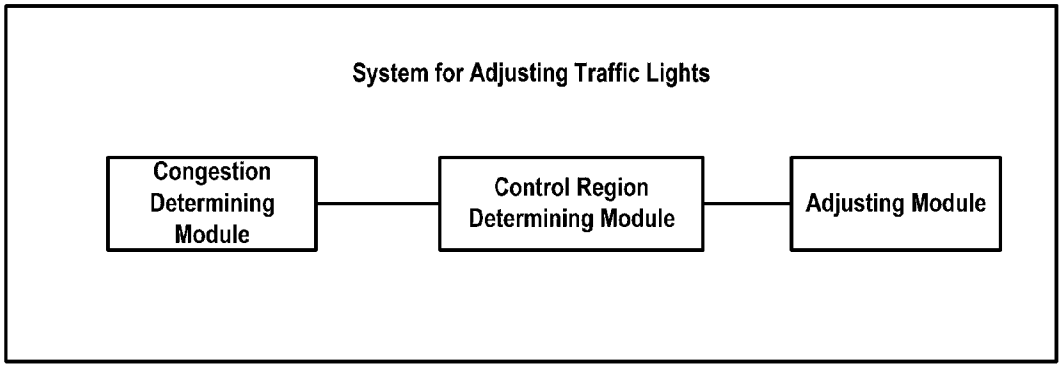
FIG. 4 is a block diagram of a system for adjusting traffic lights according to one embodiment of the present invention.

FIG. 4 illustrates a block diagram of a system for adjusting traffic lights according to one embodiment of the present invention. The system for adjusting traffic lights in FIG. 4 includes: a congestion determining module configured to determine whether traffic congestion happens at a first phase of a first intersection; a control region determining module configured to, in response to traffic congestion happening at the first phase of the first intersection, obtain a dispersion demand of the first phase of the first intersection and a dispersal capability of a corresponding phase of an adjacent intersection and determine a control region according to the dispersion demand of the first phase and the dispersal capability of the corresponding phase, wherein the control region includes at least one corresponding phase of an adjacent intersection; and a adjusting module configured to adjust traffic lights at the at least one corresponding phase of an adjacent intersection in the control region in order to relieve the traffic congestion at the first phase of the first intersection.

Figure 6:
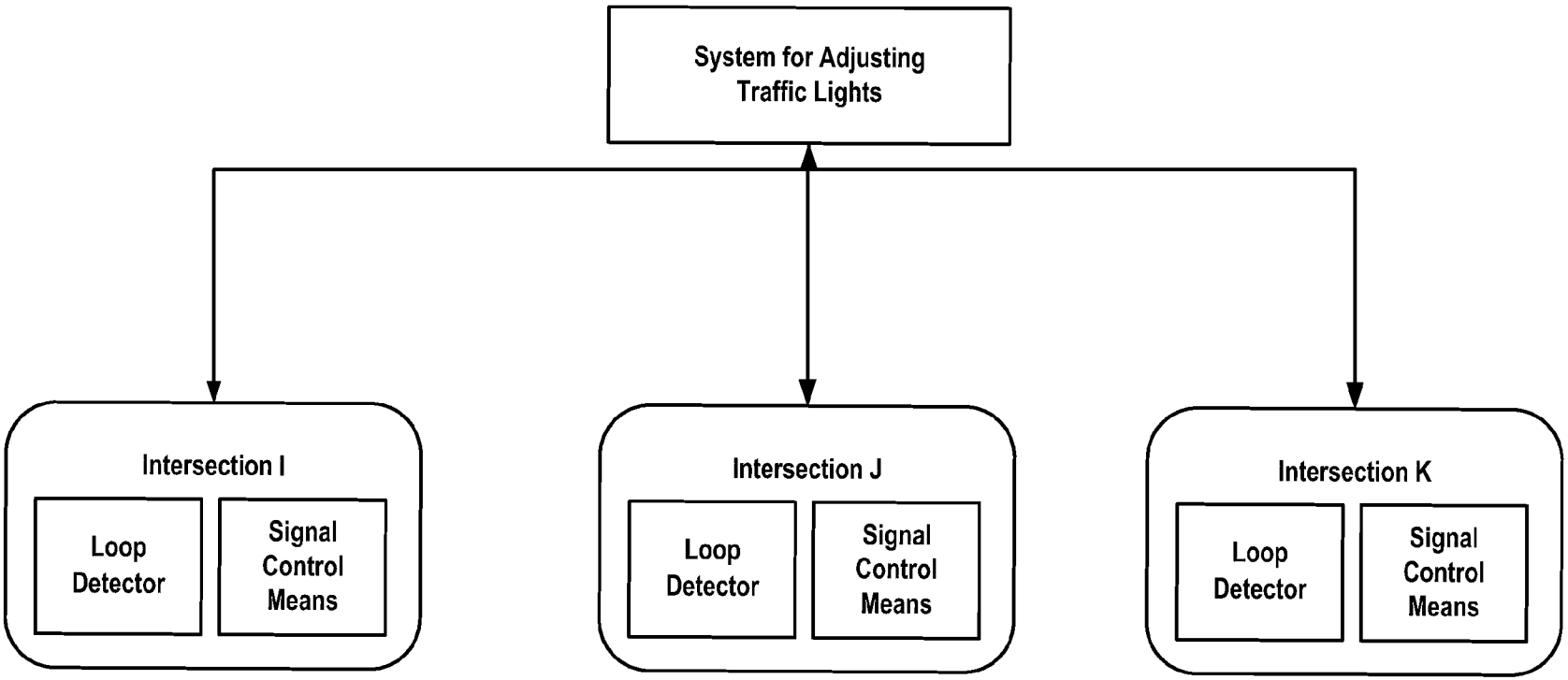
FIG. 6 is a schematic application view of a system for adjusting traffic lights according to one embodiment of the present invention.

According to one embodiment of the present invention, the congestion determining module determines whether traffic congestion happens at a first phase of a first intersection according to a policeman takeover of control right. FIG. 6 illustrates a schematic application view of a system for adjusting traffic lights according to one embodiment of the present invention. FIG. 6 schematically includes three intersections, namely intersection I, intersection J and intersection K. Each intersection includes a loop detector and signal controller. The loop detector is used for measuring a speed at at least one phase of a certain intersection, and the signal control means is used for controlling timing of traffic lights. If congestion happens at a first phase of intersection J and a policeman arrives at intersection J for manual traffic management, then the policeman can manually control the signal control means, e.g., manually adjusting timing of traffic lights. In this case, the policeman takes over control right of intersection J. Once the control right of intersection J is taken over by the policeman, it may be deemed that traffic congestion happens at intersection J.

According to another embodiment of the present invention, the congestion determining module automatically determines traffic congestion according to the number of queueing vehicles or the speed estimated by a loop detector on the road.

According to a further embodiment of the present invention, the congestion determining module may further determine traffic congestion and the number of queueing vehicles according to a camera mounted at the intersection. For example, vehicle recognition may be performed using image data captured by the camera, so as to determine whether traffic congestion happens at phase $J_a$ and to determine the number of queueing vehicles. In addition, the present invention does not exclude the use of other methods for determining traffic congestion.

In case that phase $J_a$ includes a plurality of lanes, the congestion determining module determines whether traffic congestion happens at phase $J_a$, according to the most congested lane.

It is worth explaining that the present invention does not limit the extent of traffic congestion and specific standards may be set according to practical applications.

In response to the traffic congestion happening at phase $J_a$, the control region determining module in FIG. 2 obtains a dispersion demand of phase $J_a$ and a dispersal capability of a corresponding phase of an adjacent intersection. Hereinafter, description is presented to the detailed procedure of determining a control region by taking an upstream intersection and a downstream intersection for example, respectively.

Determining an Upstream Control Region

For an upstream adjacent intersection I, the dispersion demand of phase $J_a$ is the maximum number of vehicles that can be released in a green period of upstream phases (phases $I_a$, $I_b$ and $I_d$) of upstream intersection I. The dispersal capability of an upstream phase is the minimum number of vehicles that this upstream phase can release in its green period, e.g., the minimum number of vehicles that the upstream phase can release in its green time in order to ensure that overflow or congestion does not happen at the upstream phase.

Specifically, for the upstream intersection, the dispersion demand of phase $J_a$ depends on at least the number of queueing vehicles at phase $J_a$ and the passing capability of phase $J_a$. For example, the dispersion demand of phase $J_a$ may be expressed by Equation 1:

$$R_{Ja\text{-}I}=L_{Ja}-(D_{Ja}-G_{Ja}S_{Ja}) \quad \text{Equation 1}$$

In Equation 1, $D_{Ja}$ denotes the number of queueing vehicles on phase $J_a$ (the calculation of the number of queueing vehicles will be described below in more detail). $G_{Ja}$ is the green time of phase $J_a$, $S_{Ja}$ is the flow rate of phase $J_a$ (the calculation of the flow rate will be described below in more detail), and $G_{Ja}S_{Ja}$ denotes the number of vehicles which phase $J_a$ can release in a green period, i.e., the passing capability of phase $J_a$, and $L_{Ja}$ denotes the maximum number of vehicles that phase $J_a$ can accommodate. $R_{Ja\text{-}I}$ denotes the maximum number of vehicles that an upstream phase of upstream intersection I can release in its green period, i.e., how many vehicles intersection I can release at most without causing phase $J_a$ to overflow.

Equation 1 may be varied to Equation 2:

$$R_{Ja\text{-}I}=S_{Ja}G_{Ja}-(D_{Ja}-S_{Ja}G_{Ja}) \quad \text{Equation 2}$$

The meaning of $D_{Ja}$, $G_{Ja}$ and $S_{Ja}$ in Equation 2 is the same as that in Equation 4. $R_{Ja-I}$ in Equation 2 denotes how many vehicles upstream intersection I can release at most such that all queueing vehicles at phase $J_a$ can be released in one green release period.

Equation 1 may be further varied to Equation 3:

$$R_{Ja-I}=2\times S_{Ja}G_{Ja}-(D_{Ja}-S_{Ja}G_{Ja}) \quad \text{Equation 3}$$

The meaning of $D_{Ja}$, $G_{Ja}$ and $S_{Ja}$ in Equation 3 is the same as that in Equation 1. $R_{Ja-I}$ in Equation 3 denotes how many vehicles upstream intersection I can release at most such that all queueing vehicles at phase $J_a$ can be released in two green release periods.

In practical applications, the dispersion demand of phase $J_a$ may be defined differently according to different demands. Of course, the present invention does not exclude other variations to Equation 1 for defining the dispersion demand, i.e., the maximum number of vehicles that upstream intersection I can release in its green period.

Suppose vehicles at phase $J_a$ might come from different phases $I_a$, $I_b$ and $I_d$ of an upstream intersection, i.e., vehicles at phase $I_c$ cannot u-turn to phase $J_a$, then the dispersion demand $R_{Ja-I}$ of phase $J_a$ on upstream phases may further be proportionally allocated to the three upstream phases. Equations 4, 5 and 6 below illustrate the dispersion demands $R_{Ja-Ia}$, $R_{Ja-Ib}$ and $R_{Ja-Id}$ of phase $J_a$ on three different upstream phases:

$$R_{J_a-I_a}=\frac{P_{I_a-J_a}}{P_{I_a-J_a}+P_{I_b-J_a}+P_{I_d-J_a}}R_{J_a-I} \quad \text{Equation 4}$$

$$R_{J_a-I_b}=\frac{P_{I_b-J_a}}{P_{I_a-J_a}+P_{I_b-J_a}+P_{I_d-J_a}}R_{J_a-I} \quad \text{Equation 5}$$

$$R_{J_a-I_d}=\frac{P_{I_d-J_a}}{P_{I_a-J_a}+P_{I_b-J_a}+P_{I_d-J_a}}R_{J_a-I} \quad \text{Equation 6}$$

In Equation 4, $P_{Ia-Ja}$ denotes the traffic flow from phase $I_a$ to phase $J_a$, i.e., how many vehicles are driving from phase $I_a$ to phase $J_a$ in a unit time; likewise, $P_{Ib-Ja}$ denotes the traffic flow from phase $I_a$ to phase $J_a$, and $P_{Id-Ja}$ denotes the traffic flow from phase $I_a$ to phase $J_a$.

According to one embodiment of the present invention, the dispersal capability of the upstream phase can be calculated using Equation 7:

$$Z_{Ia-Ja}=\text{Max}[0,D_{Ia}+q_{Ia}T_{Ia}-L_{Ia}] \quad \text{Equation 7}$$

In the foregoing Equation $D_{Ia}$ denotes the number of queueing vehicles at phase $I_a$ of upstream intersection I. Suppose phase $I_a$ is a through lane and vehicles at phase $I_a$ can neither turn left nor turn right, thus $q_{Ia}$ denotes the vehicle passing rate from phase $I_a$ to phase $J_a$, which can be measured by loop detectors. If phase $I_a$ is a mix of a through lane and a left-turn lane, then the calculation of should consider the proportion of going-straight vehicles to all passing vehicles at phase $I_a$. $T_{Ia}$ denotes the signal period, and $q_{Ia}T_{Ia}$ denotes the number of vehicles that arrive at phase $I_a$ in one signal period. $L_{Ia}$ denotes the maximum number of vehicles that phase $I_a$ can accommodate, and it can be obtained by dividing the road length of phase $I_a$ by an average vehicle length on the road, the average vehicle length on the road being the vehicle body length (e.g., 5 meters) plus a reasonable spacing between two vehicles (e.g., 3 meters). Further, a certain buffer may be reserved while calculating $L_{Ia}$. For example, if the above algorithm results in that $L_{Ia}=100$, then $L_{Ia}$ may be further reduced by 10 vehicles, so $L_{Ia}=90$. $D_{Ia}+q_{Ia}T_{Ia}-L_{Ia}$ denotes the number of overflowing vehicles that might happen at phase $I_a$ if no vehicle is released in one signal period. If $D_{Ia}+q_{Ia}T_{Ia}-L_{Ia}$ is more than 0, it indicates that there are relatively many vehicles at phase $I_a$; if $D_{Ia}+q_{Ia}T_{Ia}-L_{Ia}$ is less than or equal to 0, it indicates that there are relatively fewer vehicles at phase $I_a$. Max denotes the maximum value. $Z_{Ia-Ja}$ denotes the minimum number of vehicles that upstream phase $I_a$ can release in its green period while ensuring that upstream phase $I_a$ does not overflow. That $Z_{Ia-Ja}$ equals 0 indicates that it is possible to release no vehicle in one green period. Likewise, the dispersal capability $Z_{Ib-Ja}$ of phase $I_b$ and the dispersal capability $Z_{Id-Ja}$ of phase $I_d$ can be calculated using the same method.

In the above embodiment, the dispersal capability of an upstream phase is the minimum number of vehicles that this upstream phase should release in its green period in order to prevent this upstream phase from overflowing. According to another embodiment of the present invention, the dispersal capability of an upstream phase is the minimum number of vehicles that this upstream phase should release in its green period in order to prevent this upstream phase from congestion. Specifically, $L_{Ia}$ in Equation 7 may be replaced by a congestion threshold, e.g., 50 vehicles, such that $Z_{Ia-Ja}$ denotes the minimum number of vehicles that upstream phase $I_a$ can release in its green period while not causing queueing vehicles at upstream phase $I_a$ to exceed the congestion threshold.

The control region determining module in FIG. 4 is configured to determine whether or not the dispersal capability of the upstream phase can satisfy the dispersion demand of the phase $J_a$, and in response to the dispersal capability of the upstream phase satisfying the dispersion demand of the phase $J_a$, determine that the control region includes the upstream intersection; and in response to the dispersal capability of the upstream phase not satisfying the dispersion demand of the phase $J_a$, determine that the control region includes the upstream intersection I, and continue to determine whether or not a dispersal capability of a far upstream phase of the upstream phase can satisfy the dispersion demand of the upstream phase, until a dispersal capability of a far upstream phase of the upstream phase can satisfy the dispersion demand of the upstream phase.

According to one embodiment of the present invention, whether or not the dispersal capability of upstream phase $I_a$ can satisfy the dispersion demand of phase $J_a$ is determined using Equation 8:

$$Z_{Ia-Ja}<R_{Ja-Ia} \quad \text{Equation 8}$$

If Equation 8 is established, then it is deemed that the dispersal capability of phase $I_a$ for phase $J_a$ can satisfy the dispersion demand of phase $J_a$ on phase $I_a$.

Likewise, whether or not the digestion capacities of upstream phases $I_b$ and $I_d$ can satisfy the dispersion demand of phase $J_a$ may be determined using Equations 9 and 10:

$$Z_{Ib-Ja}<R_{Ja-Ib} \quad \text{Equation 9}$$

$$Z_{Id-Ja}<R_{Ja-Id} \quad \text{Equation 10}$$

If each of three upstream phases $I_a$, $I_b$ and $I_d$ can satisfy the dispersion demand of phase $J_a$, then the control region includes intersection I, and it does not need to extend to a far upstream intersection of upstream intersection I; that is, the traffic congestion problem of intersection J can be solved using the adjusting module, which is to be described in detail, to adjust traffic signals of intersection I. If none of the three upstream phases satisfies the dispersion demand of phase $J_a$ (for example, the dispersal capability of $I_a$ cannot satisfy the dispersion demand of phase $J_a$), then intersection I is included into the control region, and the control region needs to further extend to an upstream intersection of $I_a$; that is, the traffic congestion problem of intersection J cannot be completely solved using the adjusting module to adjust traffic signals of intersection I, and coordinated adjustment needs to be performed to a far upstream intersection of upstream intersection I. Specific measures are to further determine whether or not the dispersal capability of a far upstream phase of phase I can satisfy the dispersion demand of phase $I_a$, and so on and so forth, until all phases of an upstream intersection of a certain phase of a certain intersection can satisfy the dispersal capability of the certain phase.

Determining a Downstream Control Region

For a downstream adjacent intersection K, the dispersion demand of phase $J_a$ is the number of vehicles which phase $J_a$ releases in its green period, the dispersal capability is the maximum number of vehicles that can be released to the downstream phase, e.g., the maximum number of vehicles that can be released from phase $J_a$ to the downstream phase while it is ensured that overflow or congestion does not happen at the downstream phase $K_a$.

For the downstream adjacent intersection K, the dispersion demand of phase $J_a$ depends on at least the passing capability of phase $J_a$, and the passing capability of phase $J_a$ depends on at least its green period and the release flow rate of the first phase.

Suppose phase $J_a$ is a through lane, and all vehicles at phase $J_a$ will arrive at phase $K_a$. The dispersion demand of phase $J_a$ may be expressed as Equation 11:

$$R_{Ja\text{-}Ka}=G_{Ja}S_{Ja} \qquad \text{Equation 11}$$

In Equation 11, $G_{Ja}$ is the green time of phase $J_a$, $S_{Ja}$ is the release flow rate of phase $J_a$, and $R_{Ja\text{-}Ka}$ denotes the dispersion demand of phase $J_a$ on phase $K_a$ of downstream intersection K. In one embodiment, it is possible to increase the magnitude of $G_{Ja}$, e.g., increasing $G_{Ja}$ to 1.5 times as large as the original. After a policeman takes over intersection J, he will increase the green time of phase $J_a$ so as to solve the congestion problem of phase $J_a$; hence, the dispersion demand from phase $J_a$ to phase $K_a$ should be increased as well.

If phase $J_a$ is a mix of a through lane and a non-through lane, then the dispersion demand of phase $J_a$ should further consider the percentage of vehicles at phase $J_a$ that arrive at phase $K_a$.

According to one embodiment of the present invention, the dispersal capability of the downstream phase may be calculated using Equation 12:

$$Z_{Ja\text{-}Ka}=L_{ka}-(D_{ka}-G_{ka}S_{Ka}) \qquad \text{Equation 12}$$

In Equation 12, $G_{ka}$ is the green time of phase $K_a$, $S_{Ka}$ is the release flow rate of phase $K_a$, $G_{Ka}$ $S_{Ka}$ denotes the number of vehicles which phase $K_a$ can release in a green period, $D_{ka}$ denotes the number of queueing vehicles at phase $K_a$, $L_{Ka}$ denotes the maximum number of vehicles that phase $K_a$ can accommodate, and $Z_{Ja\text{-}Ka}$ denotes the maximum number of vehicles that can be released from phase $J_a$ to the downstream phase $K_a$ while it is ensured that overflow does not happen at the downstream phase $K_a$.

In the above embodiment, the dispersal capability of a downstream phase is the maximum number of vehicles that can be released from phase $J_a$ to the downstream phase while it is ensured that overflow does not happen at the downstream phase. According to another embodiment of the present invention, the dispersal capability of a downstream phase is the maximum number of vehicles that can be released from phase $J_a$ to the downstream phase while it is ensured that congestion does not happen at the downstream phase. Specifically, $L_{ka}$ in Equation 12 may be replaced by a congestion threshold, such that $Z_{Ja\text{-}Ka}$ denotes the maximum number of vehicles that can be released from phase $J_a$ to downstream phase $K_a$ while not causing the number of queueing vehicles at the downstream phase $K_a$ to exceed the congestion threshold.

The control region determining module in FIG. 4 is further configured to determine whether or not the dispersal capability of the downstream phase can satisfy the dispersion demand of the phase $J_a$, and in response to the dispersal capability of the downstream phase satisfying the dispersion demand of the phase $J_a$, determine that the control region includes the downstream intersection K; and in response to the dispersal capability of the downstream phase not satisfying the dispersion demand of the phase $J_a$, determine that the control region includes the downstream intersection K, and continue to determine whether or not a dispersal capability of a far downstream phase of the downstream phase $K_a$ can satisfy the dispersion demand of the downstream phase $K_a$, until the dispersal capability of the far downstream phase can satisfy the dispersion demand of the downstream phase.

According to one embodiment of the present invention, whether or not the dispersal capability of a downstream phase can satisfy the dispersion demand of phase $J_a$ is determined using Equation 13:

$$Z_{Ja\text{-}Ka}>R_{Ja\text{-}Ka} \qquad \text{Equation 13}$$

If Equation 13 is established, then it is deemed that the dispersal capability of the downstream phase can satisfy the dispersion demand of phase $J_a$, and in turn, it is determined that the control region includes downstream intersection K, and a dispersal capability of a far downstream intersection of downstream intersection K is not determined any more. If Equation 13 is not established, it is deemed that the dispersal capability of the downstream phase cannot satisfy the dispersion demand of phase $J_a$, and thus it is necessary to expand the scope of the control region and continue to determine whether or not a dispersal capability of a corresponding phase of a far downstream intersection of the downstream intersection K can satisfy the dispersion demand of the downstream phase, until the dispersal capability of the corresponding phase of the far downstream intersection can satisfy the dispersion demand of the downstream phase.

Calculating the Number of Queueing Vehicles

Hereinafter, detailed illustration is presented to how to calculate the number $D_{Ja}$ of queueing vehicles at phase $J_a$.

Referring to FIG. 2, if two sets of loop detectors are set up at an upstream location (a location near intersection I) and a downstream location (a location near intersection J) of phase $J_a$ of intersection J, respectively, then the number $D_{Ja}$ of vehicles between these two sets of loop detectors can be detected by the two sets of loop detectors, and in turn, whether congestion happens at $J_a$ can be determined by comparing the maximum number $L_{Ja}$ of vehicles that phase $J_a$ can be accommodate and the actually detected number $D_{Ja}$ of vehicles between these two sets of loop detectors. For example, if Equation 14 is established, it is determined that congestion happens at $J_a$:

$$|D_{Ja}-L_{Ja}|<\text{delta} \qquad \text{Equation 14}$$

where delta denotes a threshold. If the number $D_{Ja}$ of vehicles between these two sets of loop detectors is close to $L_{Ja}$ for a long time, it indicates that congestion happens at phase $J_a$.

For the purpose of cost saving, typically only one set of loop detectors is mounted at one phase. Usually a single set of loop detectors will be mounted at an upstream location of phase $J_a$, e.g. 100 meters distant from intersection I. The congestion situation and the number of queueing vehicles can be determined by a single set of loop detectors.

First, a loop detector detects a speed at which a vehicle passes through it, and then sends the speed information to the congestion determining module in FIG. 4, so that the congestion determining module may further determine the congestion situation at phase $J_a$. If the speed equals to or approximate 0, it is deemed that the congestion degree at phase $J_a$ is more than a given threshold. In other words, queuing vehicles at phase $J_a$ have congested to the location of the loop detector.

Hence, it is necessary to estimate the number of vehicles after the loop detector, so as to obtain the overall number of queueing vehicles at phase $J_a$. If the speed is more than 0, it is deemed that the congestion degree at phase $J_a$ is less than the given threshold; that is, queueing vehicles at phase $J_a$ are far from congesting to the location of the loop detector. Hence, the number of queueing vehicles at phase $J_a$ can be estimated according to the number of arriving vehicles in one signal period.

If queueing vehicles at phase $J_a$ congest to the location of the loop detector, then the number of queueing vehicles at phase $J_a$ may be estimated using Equation 15, where the number of queueing vehicles at phase $J_a$ is estimated by estimating the arrival situation of an upstream intersection.

$$D_n=D_{n-1}+\Sigma G_I S_I R_I-G_{Ja}S_{Ja} \quad \text{Equation 15}$$

In this equation, $D_{n-1}$ is the number of queueing vehicles at phase $J_a$ in the previous signal period, $D_n$ is the number of queueing vehicles at phase $J_a$ in the current signal period, $G_{Ja}$ is the green time of phase $J_a$, and $S_{Ja}$ is the release flow rate of phase $J_a$. Normally, if a speed detected by the loop detector is more than 0, then the release flow rate is a saturation flow rate. The saturation flow rate refers to saturation traffic divided by a green time, and the saturation flow rate is estimated from empirical values. In one embodiment, the saturation traffic is estimated by a model according to the planning of an intersection, such as the width of a respective lane, road conditions, the presence or absence of a median strip between motor vehicles and non-motor vehicles, etc. In another embodiment, the saturation traffic is obtained through actual measurement at an intersection, i.e., measuring the traffic flow at an intersection in a green time.

If a speed detected by the loop detector for a long time equals to or approximates 0, it is deemed that vehicles at the phase are completely in a jam, at which point the release flow rate is the flow rate q actually measured at the loop detector.

In addition, in Equation 15 $G_I$ denotes the green time in one signal period of an upstream phase of upstream intersection I of $J_a$, $S_I$ denotes the release flow rate of the upstream phase (normally, the release flow rate can be calculated using the saturation flow rate of intersection I, except that a certain phase of intersection I is already in a jam), and $R_I$ denotes the proportion entering phase $J_a$ from the upstream phase. Σ denotes computing the sum of all upstream phases so as to estimate the sum of all vehicles arriving at phase $J_a$ from upstream phases in one signal period. Illustration is given in the context of FIG. 2. Intersection I is an upstream intersection of phase $J_a$ of intersection J and includes phases $I_a$, $I_b$, $I_c$ and $I_d$, but not all vehicles at phases $I_a$, $I_b$, $I_c$ and $I_d$ will arrive at phase $J_a$. Suppose only 50% of vehicles at phase $I_a$ arrive at $J_a$, then $R_1$ equals 50%. $R_1$ may be obtained from statistical analysis of historical data, and $R_1$ might have different values in different periods of time. The number of all vehicles arriving at phase $J_a$ from respective upstream phases in one signal period may be obtained by computing the sum $G_I S_I R_I$ of each upstream intersection.

If queueing vehicles at phase $J_a$ are far from congesting to the location of the loop detector, according to one embodiment of the present invention, the queue length at phase $J_a$ at a certain moment may be calculated by iteration. Suppose the queue length at phase $J_a$ at the beginning of green release in the previous signal period is $D_{n-1}$, at which point the length of queueing vehicles is the largest, then the queue length $D_n$ at phase $J_a$ at the beginning of green release in the current signal period may be calculated using Equation 16:

$$D_n=\text{Min}[0,D_{n-1}+q_nT-G_{Ja}S_{Ja}] \quad \text{Equation 16}$$

Where $q_n$ is the vehicle flow rate passing through the loop detector at phase $J_a$ in the current signal period, i.e., the vehicle passing rate at the loop detector; T is the single period length at phase $J_a$, $G_{Ja}$ is the green time of phase $J_a$; and $S_{Ja}$ is the release flow rate of phase $J_a$. Min is to compute the minimum value. The initial value of $D_{n-1}$ may be set to 0. Equation 16 denotes the number of queueing vehicles at phase $J_a$ at the beginning of green release in the current signal period. By continuous detection, the value of $D_n$ can be obtained relatively accurately.

Adjusting an Upstream Phase

Hereinafter, detailed description is given to how to use the adjusting module to adjust traffic lights of an upstream phase in the control region.

In order to solve the congestion problem at phase $J_a$, it is possible to reduce released vehicles of an upstream phase. Hence, the adjusting module may adjust the split green ratio of the upstream phase so as to reduce released vehicles of the upstream phase.

According to one embodiment, the number of released vehicles at an upstream phase may be reduced using the Equation below:

$$G_{Ia}=\text{Min}(R_{Ja\text{-}Ia}/S_{Ia},G_{Ia\text{-}original}) \quad \text{Equation 17}$$

In the above Equation, $R_{Ja\text{-}Ia}$ is the dispersion demand of phase $J_a$ on upstream intersection $I_a$; $S_{Ia}$ is the release flow rate of phase $I_a$; $R_{Ja\text{-}Ia}/S_{Ia}$ denotes the longest green period which phase $J_a$ allows upstream phase $I_a$ to adopt; and $G_{Ia\text{-}original}$ denotes the originally set green period of phase $I_a$. Hence, if the originally set green period of phase $I_a$ is longer than the longest green period $R_{Ja\text{-}Ia}/S_{Ia}$ which phase $J_a$ allows upstream phase $I_a$ to adopt, then the longest green period which phase $J_a$ allows upstream phase $I_a$ to adopt is adopted. If the originally set green period of phase $I_a$ is shorter than the longest green period $R_{Ja\text{-}Ia}/S_{Ia}$ which phase $J_a$ allows upstream phase $I_a$ to adopt, then the originally set green period of phase $I_a$ is adopted.

Equation 17 may be further varied to Equation 18 where the green period of phase $I_a$ is set by taking into further consideration the actual number of queueing vehicles at phase $I_a$:

$$G_{Ia}=\text{Min}[R_{Ja\text{-}Ia}/S_{Ia},(D_{Ia}+q_{Ia}T_{Ia})/S_{Ia}] \quad \text{Equation 18}$$

In the above Equation, the meaning of $R_{Ja\text{-}Ia}$ and $S_{Ia}$ is the same as that in Equation 17; $G_{Ia}$ denotes the number of queueing vehicles at phase $I_a$; $q_{Ia}$ denotes the vehicle passing rate at phase $I_a$; $T_{Ia}$ denotes the signal period of phase $I_a$; $q_{Ia}T_{Ia}$ denotes the number of vehicles passing through phase $I_a$ in one signal period; and $(D_{Ia}+q_{Ia}T_{Ia})/S_{Ia}$ denotes the green time that is required for releasing all of originally queueing vehicles and newly arriving vehicles in one green release period. If there are only few queueing vehicles and arriving vehicles at phase $I_a$, i.e., if the green time that is required for releasing all of originally queueing vehicles and newly arriving vehicles at phase $I_a$ in one green release period is shorter than the longest green period which phase $J_a$ allows upstream phase $I_a$ to adopt, then a relatively long green period does not need to be set, but the green time is set according to the actual number of queueing vehicles at phase $I_a$.

Likewise, the green periods of phase $I_b$ and $I_d$ can may be adjusted using a similar method. If vehicles do not need to wait for instructions of traffic lights during right-turn driving from phase $I_d$ to $J_a$ according to traffic rules, then $G_{Id}$ may not be adjusted in this case.

Adjusting a Downstream Phase

Hereinafter, detailed description is given to how to use the adjusting module to adjust traffic lights of a downstream phase in the control region.

In one embodiment, in order to solve the congestion problem at phase $J_a$, it is possible to adjust a phase difference of a downstream phase so that vehicles coming from the first phase can pass through the downstream phase as quickly as possible.

The phase difference is the time for which the green period of the downstream phase laggs behind the green period of phase $J_a$. The phase difference may be calculated using the Equation below:

$$O_{Ja\text{-}Ka}=(L_{Ka}-D_{Ka})\times L_v/V_{Ka} \quad \text{Equation 19}$$

In the above Equation, $L_{Ka}$ is the maximum number of vehicles that phase $K_a$ can accommodate; $D_{Ka}$ is the number of queueing vehicles at phase $K_a$; $L_v$ denotes the average vehicle length on the road, which is a sum of the vehicle body length (e.g., 5 meters) plus a reasonable spacing between two vehicles (e.g., 3 meters); $V_{Ka}$ denotes the average speed at phase $K_a$ (which can be measured by a loop detector at phase $K_a$); and $O_{Ja\text{-}Ka}$ denotes the delay of the green start time at phase $K_a$ than the green start time at phase $J_a$. Equation 19 ensures that the green light at phase $K_a$ starts to release when a vehicle coming from phase $J_a$ to phase $K_a$ arrives at the tail of vehicle queue of phase $K_a$, such that vehicles coming from phase $J_a$ to phase $K_a$ can pass through the downstream phase $K_a$ as quickly as possible.

In another embodiment, to solve the congestion problem at phase $J_a$, it is possible to properly extend the split green ratio (or the green period) of downstream phase $K_a$ of phase $J_a$ so that more vehicles coming from phase $J_a$ can pass through the downstream phase $K_a$ in one signal period. In normal cases, for preventing the too long green period at a certain phase from imposing traffic pressure on other phases, the green period of traffic lights is subjected to an upper limit (for example, the maximum value of the green period of phase $K_a$ is $G_{ka\text{-}max}$), except for manual policeman intervention. In case that congestion happens at phase $J_a$, the green period of the downstream phase $K_a$ may be extended, to $G_{ka\text{-}max}$ at most.

Figure 5:
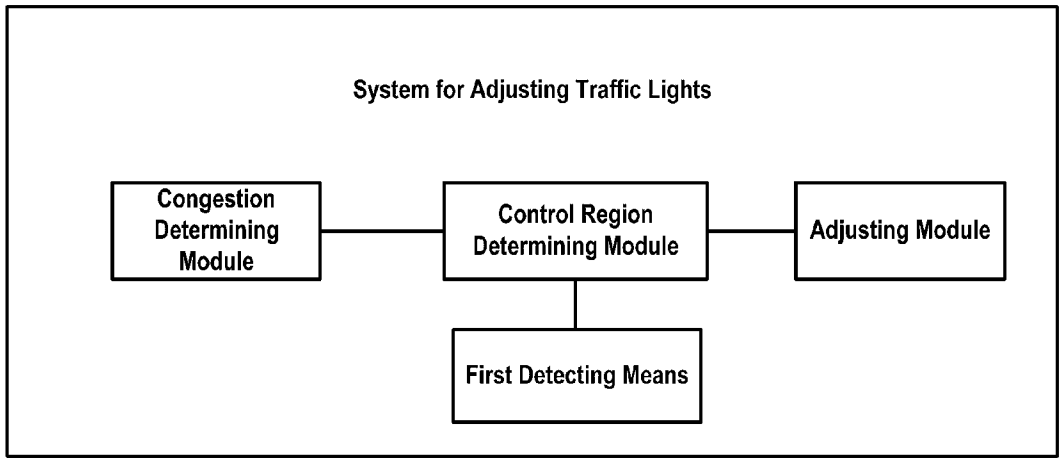
FIG. 5 is a block diagram of a system for adjusting traffic lights according to another embodiment of the present invention.

FIG. 5 illustrates a block diagram of a system for adjusting traffic lights according to another embodiment of the present invention. A congestion determining module, control region determining module and adjusting module in FIG. 5 have the same functions as those corresponding modules in FIG. 4 and accordingly are not detailed here. First detecting means in FIG. 5 is configured to detect whether or not overflow occurs at a phase in the control region, and in response to the occurrence of overflow, trigger the control region determining module to re-determine a control region. In one embodiment, the first detecting means detects whether or not overflow occurs at respective phases in the control region, and as long as overflow occurs at one of the phases, the first detecting means triggers the control region determining module to re-determine a control region. In another embodiment, the first detecting means detects whether or not overflow occurs at respective phases in the control region, and if the number of phases where overflow occurs exceeds a predetermined threshold, the first detecting means trigger the control region determining module to re-determine a control region. The first detecting means compares the number D of queueing vehicles at a certain phase with the maximum number L of vehicles that the phase can accommodate, to determine whether or not overflow occurs at the phase.

The first detecting means in FIG. 5 may be replaced by second detecting means. The second detecting means is configured to detect whether or not substantial change has occurred to the vehicle queueing situation at a phase in the control region, and in response to the occurrence of substantial change, trigger the control region determining module to re-determine a control region. In one embodiment, the second detecting means detects whether or not substantial change has occurred to respective phases in the control region, and as long as substantial change has occurred at one of the phases, the second detecting means triggers the control region determining module to re-determine a control region. In another embodiment, the second detecting means detects whether or not substantial change has occurred at respective phases in the control region, and if the number of phases where substantial change has occurred exceeds a predetermined threshold, the second detecting means trigger the control region determining module to re-determine a control region. The second detecting means compares and see whether the number D of queueing vehicles at a certain phase is larger than the maximum number L of vehicles that the phase can accommodate, to determine whether or not substantial change has occurred at the phase.

In a further embodiment, the first detecting means in FIG. 5 may be replaced by a timer such that the control region determining module is caused to automatically re-determine a control region at regular intervals (e.g., 15 minutes).

According to one embodiment of the present invention, re-determining a control region excludes from the control region phases that no longer meet conditions, so that the congestion situation in the control region is solved and the control region no longer includes any phase of any intersection.

FIG. 6 illustrates a schematic application view of a system for adjusting traffic lights according to one embodiment of the present invention. The system for adjusting traffic lights in FIG. 6 is disposed at the central server side and collects various signals sent from loop detectors and signal control means (e.g., traffic light timing controlling means) at respective intersections so as to adjust traffic lights.

According to another embodiment of the present invention, the system for adjusting traffic lights may be disposed at a local intersection, and traffic signal systems at respective local intersection are kept synchronous with each other whereby traffic lights are adjusted.

Figure 7:
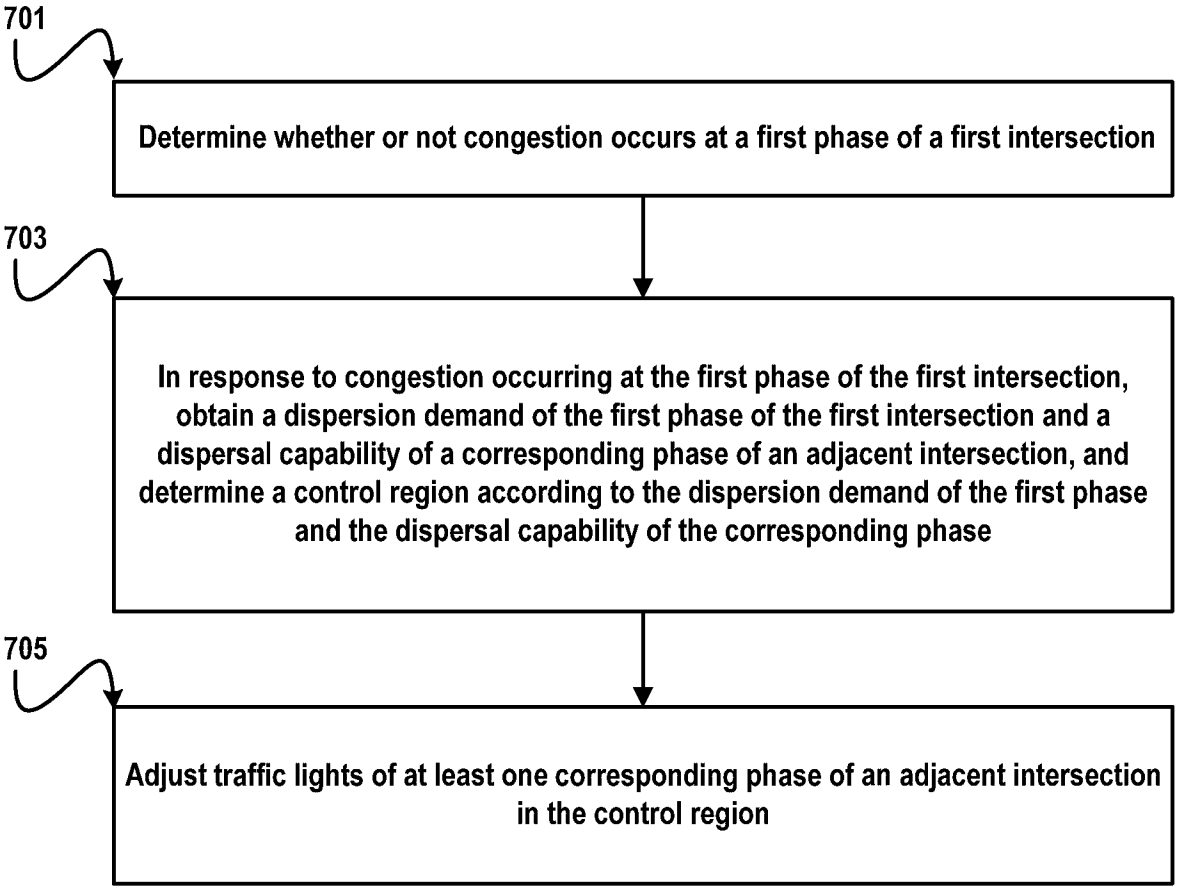
FIG. 7 is a flowchart of a method for adjusting traffic lights according to one embodiment of the present invention.

Under the same inventive concept, FIG. 7 illustrates a flowchart of a method for adjusting traffic lights according to one embodiment of the present invention. The method for adjusting traffic lights includes: at step 701, determining whether or not congestion occurs at a first phase of a first intersection; at step 703, in response to congestion occurring at the first phase of the first intersection, obtaining a dispersion demand of the first phase of the first intersection and a dispersal capability of a corresponding phase of an adjacent intersection, and determining a control region according to the dispersion demand of the first phase and the dispersal capability of the corresponding phase, wherein the control region includes at least one corresponding phase of an adjacent intersection; and at step 705, adjusting traffic lights of the at least one corresponding phase of an adjacent intersection in the control region so as to relieve the traffic congestion situation at the first phase of the first intersection.

According to one embodiment of the present invention, the adjacent intersection is an upstream intersection of the first intersection, a corresponding phase of the upstream intersection is an upstream phase of the first phase, the dispersion demand of the first phase is the maximum number of vehicles that the upstream phase can release in its green period, and the dispersal capability is the minimum number of vehicles that the upstream phase can release in its green period.

Figure 8A:
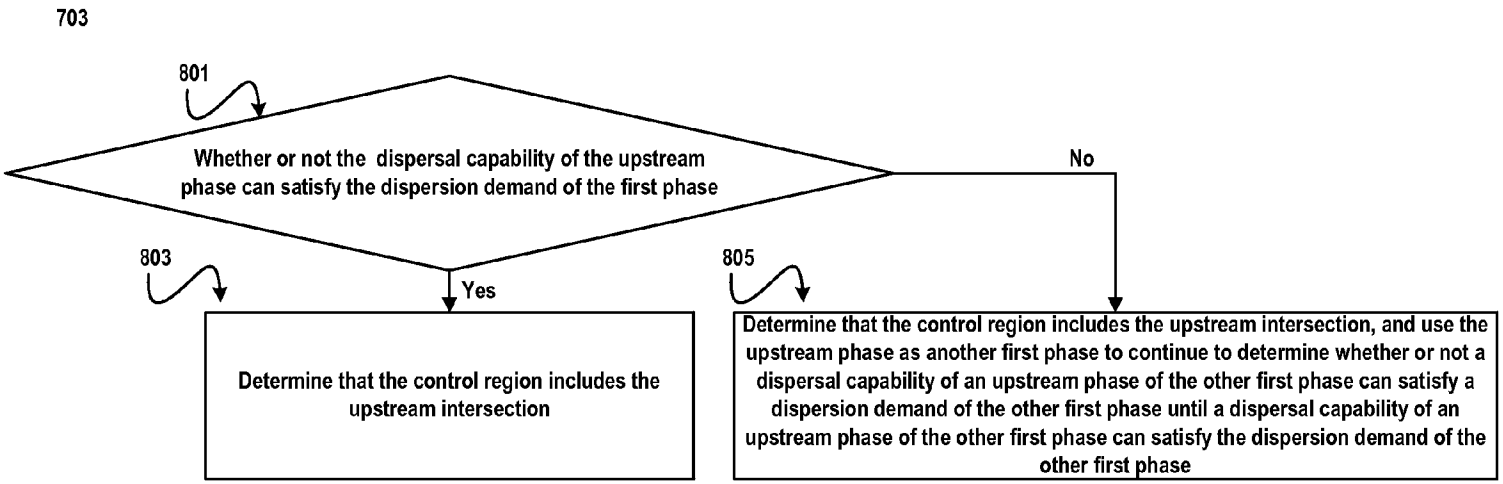
FIG. 8A is a flowchart of a method for determining an upstream intersection in a control region according to one embodiment of the present invention.

FIG. 8A illustrates a flowchart of a method for determining an upstream intersection in a control region according to one embodiment of the present invention. At step 801, it is determined whether or not the dispersal capability of the upstream phase can satisfy the dispersion demand of the first phase; at step 803, in response to the dispersal capability of the upstream phase satisfying the dispersion demand of the first phase, determining that the control region includes the upstream intersection; and at step 805, in response to the dispersal capability of the upstream phase not satisfying the dispersion demand of the first phase, determining that the control region includes the upstream intersection, and using the upstream phase as another first phase to continue to determine whether or not a dispersal capability of an upstream phase of the other first phase can satisfy a dispersion demand of the other first phase until a dispersal capability of an upstream phase of the other first phase can satisfy the dispersion demand of the other first phase.

According to one embodiment, for an upstream phase, adjusting traffic lights further includes adjusting the split green ratio of the upstream phase so as to reduce released vehicles of the upstream phase.

According to one embodiment of the present invention, the adjacent intersection further includes a downstream intersection of the first intersection, a corresponding phase of the downstream intersection is a downstream phase of the first phase, the dispersion demand of the first phase is the number of vehicles which the first phase can release in its green period, and the dispersal capability is the maximum number of vehicles that the first phase can release to the downstream phase.

Figure 8B:
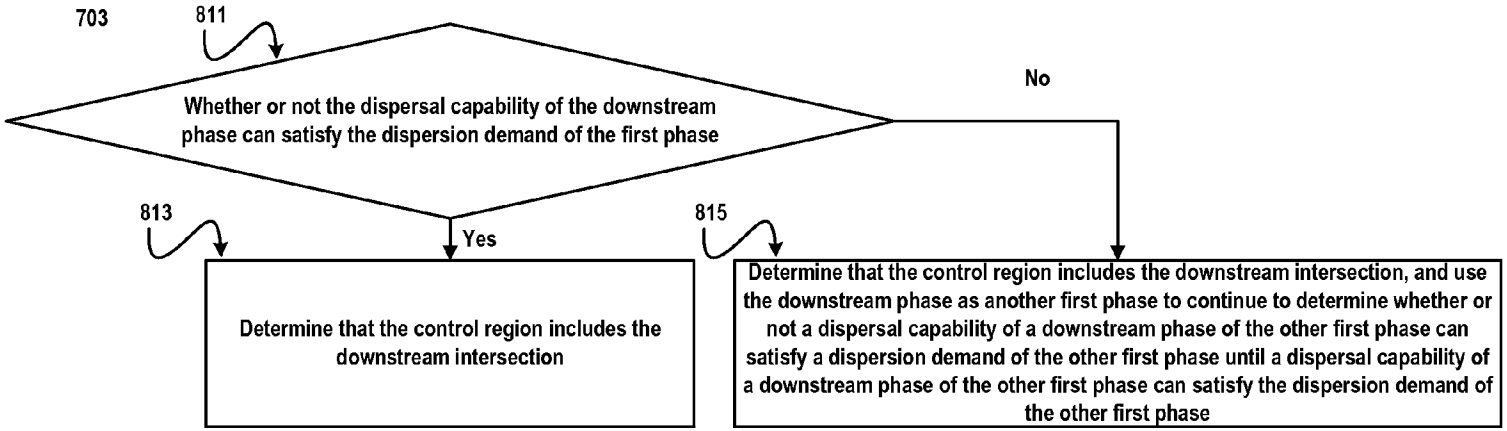
FIG. 8B is a flowchart of a method for determining a downstream intersection in a control region according to another embodiment of the present invention.

FIG. 8B illustrates a flowchart of a method for determining a downstream intersection in a control region according to another embodiment of the present invention. At step 811, it is determined whether or not the dispersal capability of the downstream phase can satisfy the dispersion demand of the first phase; at step 813, in response to the dispersal capability of the downstream phase satisfying the dispersion demand of the first phase, determining that the control region includes the downstream intersection; and at step 815, in response to the dispersal capability of the downstream phase not satisfying the dispersion demand of the first phase, determining that the control region includes the downstream intersection, and using the downstream phase as another first phase to continue to determine whether or not a dispersal capability of a downstream phase of the other first phase can satisfy a dispersion demand of the other first phase until a dispersal capability of a downstream phase of the other first phase can satisfy the dispersion demand of the other first phase.

According to one embodiment, for a downstream phase, adjusting traffic lights further includes adjusting a phase difference of the downstream phase so that vehicles coming from the first phase pass through the downstream phase as quickly as possible.

The various embodiments of the present invention can provide many advantages, including those enumerated in the disclosure of the present invention and to be derived from the technical solution itself. No matter whether one embodiment achieves all advantages or whether such advantages are considered substantial improvements, it should not constitute any limitation to the present invention. Meanwhile, the embodiments presented above are only for the illustration purpose, and various modifications and alterations may be made to the embodiments by those of ordinary skill in the art without departing from the essence of the present invention. The scope of the present invention is completely defined by the appended claims.

What is claimed is:

1. A system for adjusting traffic lights, comprising:

a congestion determining module configured to determine whether or not congestion occurs at a first phase of a first intersection;

a control region determining module configured to, in response to congestion occurring at the first phase of the first intersection, obtain a dispersion demand of the first phase of the first intersection and a dispersal capability of a corresponding phase of an adjacent intersection, and determine a control region according to the dispersion demand of the first phase and the dispersal capability of the corresponding phase, wherein the control region includes at least one corresponding phase of an adjacent intersection; and an adjusting module configured to adjust traffic light(s) of the at least one corresponding phase of an adjacent intersection in the control region so as to relieve the traffic congestion situation at the first phase of the first intersection;

wherein said adjacent intersection includes an upstream intersection of the first intersection, the corresponding phase of the upstream intersection is an upstream phase of the first phase, the dispersion demand of the first phase is a maximum number of vehicles that the upstream phase can release in its green period, and the dispersal capability is the minimum number of vehicles that the upstream phase needs to release in its green period; and wherein the adjusting module is further configured to adjust the split green ratio of the upstream phase so as to reduce released vehicles of the upstream phase.

2. The system according to claim 1, wherein the dispersion demand of the first phase depends on at least a passing capability of the first phase and a number of queueing vehicles at the first phase, the passing capability of the first phase depends on at least a green period of the first phase and a release flow rate of the first phase, and the number of queueing vehicles at the first phase depends on at least a queue length in a previous signal period and a number of vehicles arriving at the first phase in a current signal period.

3. The system according to claim 1, wherein the control region determining module is further configured to:

determine whether or not the dispersal capability of the upstream phase can satisfy the dispersion demand of the first phase; and in response to the dispersal capability of the upstream phase satisfying the dispersion demand of the first phase, determine that the control region includes the upstream intersection; and in response to the dispersal capability of the upstream phase not satisfying the dispersion demand of the first phase, determine that the control region includes the upstream intersection, and use the upstream phase as another first phase to continue to determine whether or not a dispersal capability of an upstream phase of the other first phase can satisfy the dispersion demand of the other first phase, until a dispersal capability of an upstream phase of the other first phase can satisfy the dispersion demand of the other first phase.

4. The system according to claim 1, further comprising:

first detecting means configured to detect whether or not overflow occurs at the first phase of the first intersection or the corresponding phase of the adjacent intersection in the control region, and in response to the occurrence of overflow, trigger the control region determining module to re-determine a control region.

5. The system according to claim 1, further comprising:

second detecting means configured to detect whether or not substantial change occurs to the vehicle queueing situation at the first phase of the first intersection or the corresponding phase of the adjacent intersection in the control region, and in response to the occurrence of substantial change, trigger the control region determining module to re-determine a control region.

6. The system according to claim 1, wherein in case that the first phase includes a plurality of lanes, the congestion determining module determines whether or not traffic congestion occurs at the first phase, according to the most congested lane.

7. A method for adjusting traffic lights, comprising:

determining whether or not congestion occurs at a first phase of a first intersection;

in response to congestion occurring at the first phase of the first intersection, obtaining a dispersion demand of the first phase of the first intersection and a dispersal capability of a corresponding phase of an adjacent intersection, and determining a control region according to the dispersion demand of the first phase and the dispersal capability of the corresponding phase, wherein the control region includes at least one corresponding phase of an adjacent intersection; and adjusting traffic light(s) of the at least one corresponding phase of an adjacent intersection in the control region so as to relieve the traffic congestion situation at the first phase of the first intersection;

wherein the adjacent intersection includes an upstream intersection of the first intersection, the corresponding phase of the upstream intersection is an upstream phase of the first phase, the dispersion demand of the first phase is a maximum number of vehicles that the upstream phase can release in its green period, and the dispersal capability is the minimum number of vehicles that the upstream phase needs to release in its green period;

wherein the determining a control region further comprising:

determining whether or not the dispersal capability of the upstream phase can satisfy the dispersion demand of the first phase; and in response to the dispersal capability of the upstream phase satisfying the dispersion demand of the first phase, determining that the control region includes the upstream intersection; and in response to the dispersal capability of the upstream phase not satisfying the dispersion demand of the first phase, determining that the control region includes the upstream intersection, and using the upstream phase as another first phase to continue to determine whether or not a dispersal capability of an upstream phase of the other first phase can satisfy the dispersion demand of the other first phase, until a dispersal capability of an upstream phase of the other first phase can satisfy the dispersion demand of the other first phase; and wherein at least one of the steps is carried out by a computing device.

8. The method according to claim 7, wherein the adjusting traffic lights further comprises adjusting the split green ratio of the upstream phase so as to reduce released vehicles of the upstream phase.

9. The method according to claim 7, wherein the adjacent intersection further includes a downstream intersection of the first intersection, the corresponding phase of the downstream intersection is a downstream phase of the first phase, the dispersion demand of the first phase is a number of vehicles that the first phase releases in its green period, and the dispersal capability is a maximum number of vehicles that the first phase can release to the downstream phase.

10. The method according to claim 9, wherein the determining a control region further comprises:

determining whether or not the dispersal capability of the downstream phase can satisfy the dispersion demand of the first phase; and in response to the dispersal capability of the downstream phase satisfying the dispersion demand of the first phase, determining that the control region includes the downstream intersection; and in response to the dispersal capability of the downstream phase not satisfying the dispersion demand of the first phase, determining that the control region includes the downstream intersection, and using the downstream phase as another first phase to continue to determine whether or not a dispersal capability of a downstream phase of the other first phase can satisfy the dispersion demand of the other first phase, until a dispersal capability of a downstream phase of the other first phase can satisfy the dispersion demand of the other first phase.

11. The method according to claim 9, wherein the adjusting traffic lights further comprises adjusting a phase difference of the downstream phase so that vehicles coming from the first phase pass through the downstream phase as quickly as possible.

12. A system for adjusting traffic lights, comprising:

a congestion determining module configured to determine whether or not congestion occurs at a first phase of a first intersection;

a control region determining module configured to, in response to congestion occurring at the first phase of the first intersection, obtain a dispersion demand of the first phase of the first intersection and a dispersal capability of a corresponding phase of an adjacent intersection, and determine a control region according to the dispersion demand of the first phase and the dispersal capability of the corresponding phase, wherein the control region includes at least one corresponding phase of an adjacent intersection; and an adjusting module configured to adjust traffic light(s) of the at least one corresponding phase of an adjacent intersection in the control region so as to relieve the traffic congestion situation at the first phase of the first intersection;

wherein the adjacent intersection further includes a downstream intersection of the first intersection, the corresponding phase of the downstream intersection is a downstream phase of the first phase, the dispersion demand of the first phase is a number of vehicles that the first phase releases in its green period, and the dispersal capability is a maximum number of vehicles that the first phase can release to the downstream phase; and wherein the control region determining module is further configured to:

determine whether or not the dispersal capability of the downstream phase can satisfy the dispersion demand of the first phase; and in response to the dispersal capability of the downstream phase satisfying the dispersion demand of the first phase, determine that the control region includes the downstream intersection; and in response to the dispersal capability of the downstream phase not satisfying the dispersion demand of the first phase, determine that the control region includes the downstream intersection, and use the downstream phase as another first phase to continue to determine whether or not a dispersal capability of a downstream phase of the other first phase can satisfy the dispersion demand of the other first phase, until a dispersal capability of a downstream phase of the other first phase can satisfy the dispersion demand of the other first phase.

13. The system according to claim 12, wherein the dispersion demand of the first phase depends on at least a passing capability of the first phase and a number of queueing vehicles at the first phase, the passing capability of the first phase depends on at least a green period of the first phase and a release flow rate of the first phase, and the number of queueing vehicles at the first phase depends on at least a queue length in a previous signal period and a number of vehicles arriving at the first phase in a current signal period.

14. The system according to claim 12, further comprising:

first detecting means configured to detect whether or not overflow occurs at the first phase of the first intersection or the corresponding phase of the adjacent intersection in the control region, and in response to the occurrence of overflow, trigger the control region determining module to re-determine a control region.

15. The system according to claim 12, further comprising: second detecting means configured to detect whether or not substantial change occurs to the vehicle queueing situation at the first phase of the first intersection or the corresponding phase of the adjacent intersection in the control region, and in response to the occurrence of substantial change, trigger the control region determining module to re-determine a control region.

16. The system according to claim 12, wherein in case that the first phase includes a plurality of lanes, the congestion determining module determines whether or not traffic congestion occurs at the first phase, according to the most congested lane.

17. The system according to claim 12, wherein the dispersion demand of the first phase depends on at least a passing capability of the first phase, wherein the passing capability of the first phase depends on at least a green period of the first phase and a release flow rate of the first phase.

18. The system according to claim 12, wherein the adjusting module is further configured to adjust a phase difference of the downstream phase so that vehicles coming from the first phase pass through the downstream phase as quickly as possible.

19. The system according to claim 17, wherein the congestion determining module is further configured to determine whether or not vehicles at the first phase are in a jam, and in case that vehicles at the first phase are in a jam, the release flow rate of the first phase is an actually measured flow rate of the first phase, and in case that vehicles at the first phase are not in a jam, the release flow rate of the first phase is estimated from empirical values.

* * * * *